US012252288B2

(12) United States Patent
Yin et al.

(10) Patent No.: US 12,252,288 B2
(45) Date of Patent: Mar. 18, 2025

(54) SMART HEAT SEALING METHOD FOR VACUUM PACKAGING

(71) Applicant: GUANGZHOU ARGION ELECTRIC APPLIANCE CO., LTD., Guangdong (CN)

(72) Inventors: Zhicun Yin, Guangdong (CN); Guoqiang Liang, Guangdong (CN); Xiao Tang, Guangdong (CN)

(73) Assignee: GUANGZHOU ARGION ELECTRIC APPLIANCE CO., LTD., Guangzhou (CN)

( * ) Notice: Subject to any disclaimer, the term of this patent is extended or adjusted under 35 U.S.C. 154(b) by 34 days.

(21) Appl. No.: 18/224,566

(22) Filed: Jul. 20, 2023

(65) Prior Publication Data

US 2024/0294290 A1 Sep. 5, 2024

(30) Foreign Application Priority Data

Mar. 3, 2023 (CN) ..... 202310203488.7

(51) Int. Cl.

| | |
|---|---|
| ***B65B 57/00*** | (2006.01) |
| ***B65B 31/04*** | (2006.01) |
| ***B65B 51/10*** | (2006.01) |

(52) U.S. Cl.

CPC ..... *B65B 57/00* (2013.01); *B65B 31/046* (2013.01); *B65B 51/10* (2013.01); *B65B 2051/105* (2013.01)

(58) Field of Classification Search

CPC ... B29C 51/46; B65B 51/10; B65B 2051/105; B65B 31/046; B65B 57/00

See application file for complete search history.

(56) References Cited

U.S. PATENT DOCUMENTS

2018/0222619 A1* 8/2018 Ehrmann ..... B29C 66/849

* cited by examiner

*Primary Examiner* — Daniel Jeremy Leeds

(57) ABSTRACT

The disclosure provides a smart heat sealing method for vacuum packaging, comprising steps of: recording a time interval Δt between two adjacent starts of a heating device which is continuously started a number of times; recording a number k of starts of the heating device; obtaining a first heating coefficient $p_1$ based on Δt, obtaining a second heating coefficient $p_2$ based on k, selecting the heating constant t depending on specified parameters and performance of the vacuum package machine, and calculating the heating time T for next operation of the heating device by a formula $T=p_1*p_2*t$ based on $p_1$, $p_2$, and t. It solves the heat accumulation problem of the heating device caused by too much repeated use or overuse in short time interval, and thus avoids unsuccessful vacuuming and solves the problem of poor heat sealing effect, and greatly improves user experience.

7 Claims, 1 Drawing Sheet

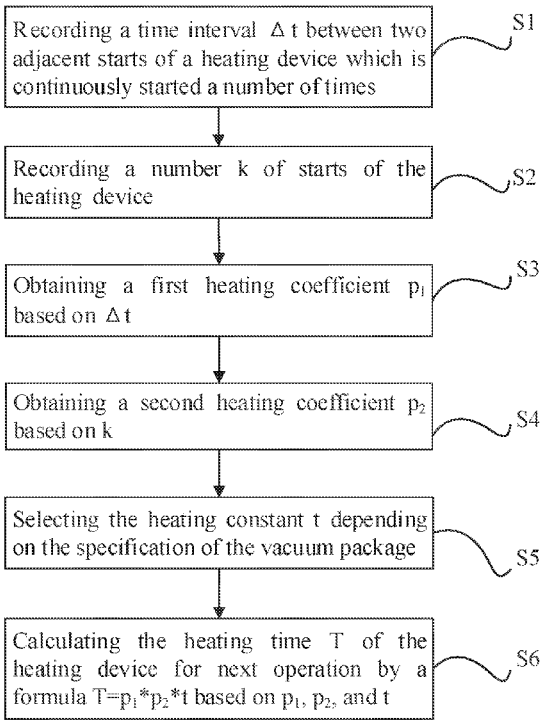

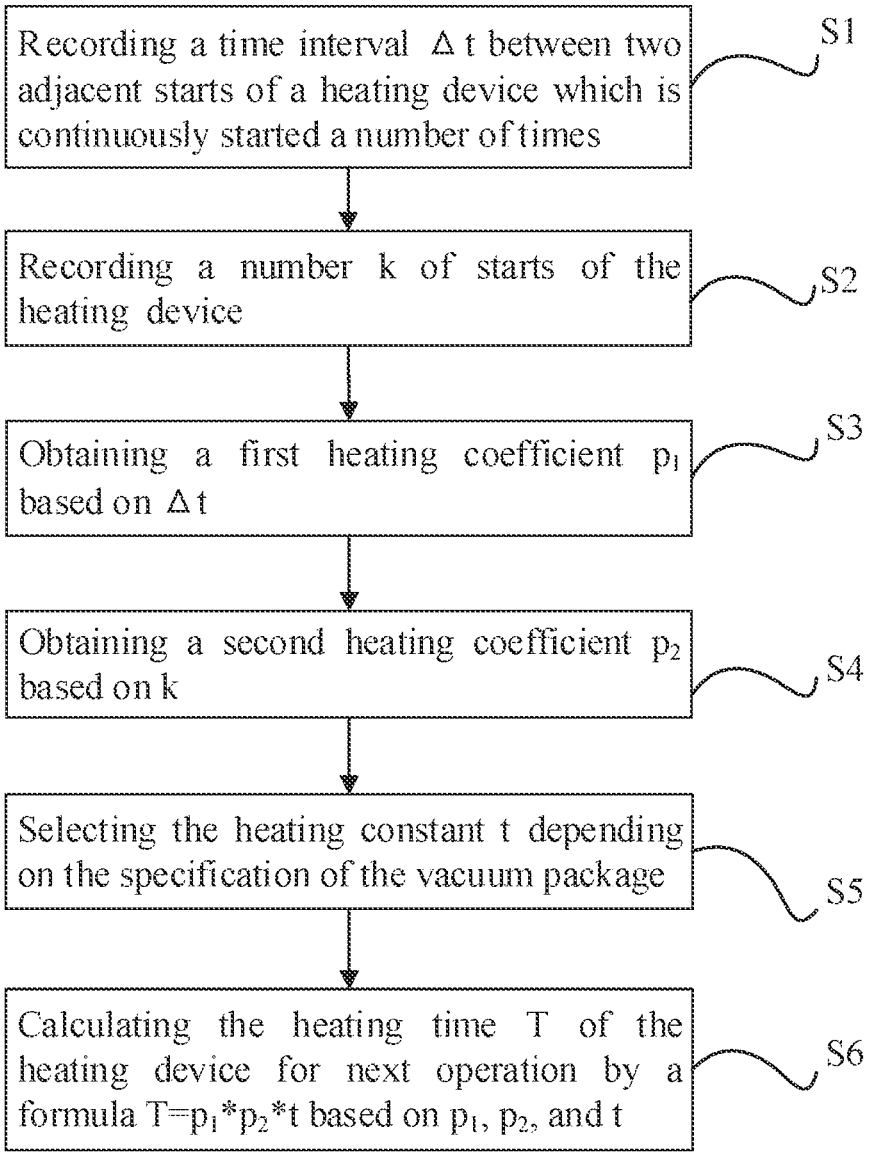
Recording a time interval Δt between two adjacent starts of a heating device which is continuously started a number of times
S1
Recording a number k of starts of the heating device
S2
Obtaining a first heating coefficient $p_1$ based on Δt
S3
Obtaining a second heating coefficient $p_2$ based on k
S4
Selecting the heating constant t depending on the specification of the vacuum package
S5
Calculating the heating time T of the heating device for next operation by a formula $T=p_1*p_2*t$ based on $p_1$, $p_2$, and t
S6

SMART HEAT SEALING METHOD FOR VACUUM PACKAGING

CROSS REFERENCE TO RELATED APPLICATIONS

The present application claims the benefit of Chinese Patent Application No. 202310203488.7 filed on Mar. 3, 2023, the contents of which are incorporated herein by reference in their entirety.

TECHNICAL FIELD

The disclosure relates to the technical field of vacuum packaging, more particularly to a smart heat sealing method for vacuum packaging.

BACKGROUND

Existing vacuum package machines usually accomplish sealing of vacuum package, after vacuuming of the vacuum package, by using a heating wire to heat and melt the opening of the vacuum package. Such method is referred to as the heat sealing process for vacuum packaging. As the vacuum package is melted due to high temperature of the heating wire during the whole process, the temperature change of the heating wire would affect the heat sealing process. In particular, the heating wire of the vacuum package machine which needs to heat for a certain period of time also needs a certain period of time to cool down after each heat sealing process. If the heating wire is overused without enough break time for heat dissipation so as to increase heat sealing efficiency, it may be overheated. In such a case, the vacuum package may be heat-sealed too early to cause unsuccessful vacuuming due to high temperature of the heating wire, or may be melted down due to over-high temperature. In view of these problems, some vacuum package machines available in the market raise a requirement, in the warning label, for users to increase the time interval for completing heat dissipation of the heating wire between two vacuuming processes. However, it apparently requires users to additionally record heat dissipation time, increases workload, and brings poor user experience. Furthermore, in order to increase time of heat dissipation to avoid overheat, some vacuum package machines are set with determined time interval for heat dissipation. That is, the heating device may be forced to disable activation if the time interval between two processes of the heating device does not reach the predetermined heat dissipation time. Though such operation may relieve heat dissipation problem in some extent, it cannot meet requirements of all users. For example, it cannot meet some requirements such as instant heat-sealing, and the users have to wait for heat dissipation to finish. It also provides poor user experience.

SUMMARY

To solve the above technical problems, an object of the disclosure is to provide a smart heat sealing method for vacuum packaging, which can achieve dynamic control of the heating time of the heating device and has advantages such as simple algorithm and good heating effect.

On such basis, the disclosure provides a smart heat sealing method for vacuum packaging, comprising steps of:

recording a time interval $\Delta t$ between two adjacent starts of a heating device which is continuously started a number of times;

recording a number k of starts of the heating device;

obtaining a heating time T of the heating device for next operation based on $\Delta t$ and k; and resetting k as 1 when $\Delta t \geq 600$ s.

In some embodiments of the disclosure, the method may comprise obtaining a first heating coefficient $p_1$ from a preset database based on $\Delta t$, obtaining a second heating coefficient $p_2$ from a preset database based on k, and calculating the heating time T after current activation of the heating device by a formula $T=p_1*p_2*t$ based on $p_1$ and $p_2$, wherein t indicates a time constant selected depending on a specified parameter and performance of a vacuum package machine.

In some embodiments of the disclosure, the first heating coefficient $p_1$ and the time interval $\Delta t$ may have relationships as follows:

$$\text{if } 0 < \Delta t < t_1,\ 0 < p_1 < 1;$$

$$\text{if } t_1 \leq \Delta t < t_2,\ p_1 = 1;\ \text{and}$$

$$\text{if } \Delta t > t_2,\ p_1 > 1;$$

wherein $t_1$ and $t_2$ are preset values.

In some embodiments of the disclosure, wherein $t_1$ may be 25 s and $t_2$ may be 600 s.

In some embodiments of the disclosure, if $0<\Delta t<25$ s, $p_1$ may be 0.6.

In some embodiments of the disclosure, if $0<\Delta t<25$ s, $p_1$ may be 0.8.

In some embodiments of the disclosure, if $\Delta t>600$ s, $p_1$ may be 1.2.

In some embodiments of the disclosure, the second heating coefficient $p_2$ and the number k of starts may have relationships as follows:

$$\text{if } k = 1,\ p_2 > 1;$$

$$\text{if } 1 < k \leq K,\ p_2 = 1;\ \text{and}$$

$$\text{if } k > K,\ 0 < p_2 < 1;$$

wherein K indicates a critical value of the number of times of continuous starts of the heating device.

Compared with the prior art, the smart heat sealing method for vacuum packaging according to the embodiment of the disclosure has advantages as follows.

The disclosure provides a smart heat sealing method for vacuum packaging, which measures the time interval $\Delta t$ between two adjacent heating operations and the number k of starts of the heating device to achieve dynamic adjustment of current heating time T of the heating device. It solves the heat accumulation problem of the heating device caused by too much repeated use or overuse in short time interval, and greatly improves user experience.

BRIEF DESCRIPTION OF THE DRAWINGS

The sole FIGURE is a process flow diagram which illustrates calculation of heating time T of a smart heat sealing method for vacuum packaging according to an embodiment of the disclosure.

DETAILED DESCRIPTION OF ILLUSTRATED EMBODIMENTS

The embodiments of the disclosure will be further explained below in detail with reference to drawings and embodiments. The embodiments are illustrative and are not intended to limit the scope of the invention.

It should be noted that the terms such as "front" and "rear" used in the description are only used to distinguish one element from another and are not intended to limit the scope. For example, "front" element may refer to "rear" element, and "rear" element may refer to "front" element, without departing from the scope of the disclosure. In the description, "front" side refers to the side of the vacuum package which faces the operating personnel.

Referring to the sole FIGURE, the disclosure provides a smart heat sealing method for vacuum packaging, comprising steps of:

S1. Recording the time interval $\Delta t$ between two adjacent starts of the heating device which is continuously started a number of times;

S2. Recording the number k of starts of the heating device;

S3. Obtaining the first heating coefficient $p_1$ based on $\Delta t$;

S4. Obtaining the second heating coefficient $p_2$ based on k;

S5. Selecting the heating constant t depending on specified parameters and performance of the vacuum package machine; and

S6. Based on $p_1$, $p_2$, and t, calculating a heating time T of the heating device for next operation by a formula $T=p_1*p_2*t$.

Based on the above description, the smart heat sealing method for vacuum packaging of the disclosure can obtain the forthcoming heating time T of the heating device based on the time interval $\Delta t$ between two starts of the heating device and the number k of starts of the heating device, and can achieve the real time and dynamic control of the heating time of the heating device.

In particular, the heating time T of the heating device of the disclosure can be calculated by the formula $T=p_1*p_2*t$, wherein $p_1$ indicates the first heating coefficient obtained from the preset database based on $\Delta t$; $p_2$ indicates the second heating coefficient obtained from the preset database based on k; and t indicates the time constant selected depending on specified parameters and performance of the vacuum package machine. The first heating coefficient $p_1$ and the time interval $\Delta t$ may have relationships as follows.

$$\text{If } 0 < \Delta t < t_1,\ 0 < p_1 < 1;$$

$$\text{If } t_1 \le \Delta t < t_2,\ p_1 = 1;$$

$$\text{If } \Delta t > t_2,\ p_1 > 1;$$

Herein, $t_1$ and $t_2$ are preset values. In the embodiment of the disclosure, $t_1$ may be 25 s, and $t_2$ may be 600 s.

It can be seen that, if the number k of starts is fixed (i.e., $p_2$ is kept in a corresponding interval and the value of $p_1$ is critical for the heating time T of the heating device), the shorter the interval between two starts of the heating device, the less the heat dissipation time of the heating device. In such a case, the heating device has heat energy remained from previous heating. Consequently, in order to prevent the vacuum package from being overheated by the heating device operated too long, the heating time of the heating device should be reduced appropriately when the time interval between two starts of the heating device is relatively short ($0<\Delta t<t_1$). That is, 0<the first heating coefficient $p_1<1$, and thus the heating time of the heating device can be reduced. When the time interval between two starts of the heating device tends to be normal ($t_1\le\Delta t<t_2$), the heating time should be kept relatively stable. In such a case, the first heating coefficient $p_1=1$. When the time interval between two starts of the heating device is too long ($\Delta t>t_2$), the heating device, which has enough time to complete heat dissipation in the long interval, has relatively low temperature. In such a case, the heating time of the heating wire should be increased to some extent, to ensure the effect of heating vacuum package.

In particular, in some embodiments of the disclosure, $p_1$ may be preferably 0.6 or 0.8 when $0<\Delta t<25$ s, and preferably 1.2 when $\Delta t>600$ s.

Furthermore, the second heating coefficient $p_2$ and the number k of starts may have relationships as follows.

$$\text{If } k = 1,\ p_2 > 1;$$

$$\text{If } 1 < k \le K,\ p_2 = 1;$$

$$\text{If } k > K,\ 0 < p_2 < 1;$$

Herein, K indicates a critical value of the number of times of starts of the heating device.

It is apparent that, if the time interval $\Delta t$ between two heating operations of the heating device is kept in a certain fixed interval (i.e., $p_1$ is kept in a corresponding interval, $t_1$ is kept greater than 1 or less than 1, and the value of $p_2$ is critical for the heating time T of the heating device), when the number k of starts of the heating device=1, the heating device is started for the first time, and thus the heating time of the heating device should be increased due to cold start, so as to ensure the effect of the first time of heat sealing. In such a case, $p_2>1$. Furthermore, when 1<the number k of starts of the heating devices≤K, the heating device stably operates to heat. Thus, as long as the heating time of the heating device is unchanged, the heating device can keep stable heating. In such a case, $p_2=1$. Moreover, when k>K, the heating device has accumulated some heat energy during repeated use. Thus, the heating time of the heating device should be reduced, to avoid inappropriate heat sealing caused by heat accumulation.

It should be noted that, depending on various heat sealing situations, if the time interval between two activations of the heating device is too long, the heating device can be determined as being completely cooled down. In such a case, the heating device should be operated in a manner of initial activation. That is, the heating device may be determined as being initially started. In the embodiment of the disclosure, the critical value may be set as 600 s. That is, if the time interval $\Delta t$ between two starts of the heating device is greater than or equal to 600 s, k can be reset as 1, and the heating device may return to operating state after a long time of heating.

To sum up, the disclosure provides a smart heat sealing method for vacuum packaging, which measures the time interval Δt between two adjacent heating operations and the number k of starts of the heating device to achieve dynamic adjustment of current heating time T of the heating device. It solves the heat accumulation problem of the heating device caused by too much repeated use or overuse in short time interval, and greatly improves user experience.

All the above are merely some preferred embodiments of the disclosure. It should be noted that the disclosure is intended to cover various modifications and equivalent arrangements made by those skilled in the art and included within the principle of the disclosure.

The invention claimed is:

1. A smart heat sealing method for vacuum packaging, comprising steps of:

recording a time interval Δt between two adjacent starts of a heating device which is continuously started a number of times;

recording a number k of starts of the heating device;

obtaining a heating time T of the heating device for next operation based on Δt and k, which comprises: obtaining a first heating coefficient $p_1$ from a preset database based on Δt, obtaining a second heating coefficient $p_2$ from a preset database based on k, and calculating the heating time T of the heating device after current activation by a formula $T=p_1*p_2*t$ based on $p_1$ and $p_2$, wherein t indicates a time constant selected depending on a specified parameter and performance of a vacuum package machine; and resetting k as 1 when Δt≥600 s.

2. The smart heat sealing method for vacuum packaging according to claim 1, wherein the first heating coefficient $p_1$ and the time interval Δt have relationships as follows:

$$\text{if } 0 < \Delta t < t_1,\ 0 < p_1 < 1;$$

$$\text{if } t_1 \le \Delta t < t_2,\ p_1 = 1;\ \text{and}$$

$$\text{if } \Delta t > t_2,\ p_1 > 1;$$

wherein, $t_1$ and $t_2$ are preset values.

3. The smart heat sealing method for vacuum packaging according to claim 2, wherein $t_1$ is 25 s and $t_2$ is 600 s.

4. The smart heat sealing method for vacuum packaging according to claim 3, wherein, if $0<\Delta t<25$ s, $p_1=0.6$.

5. The smart heat sealing method for vacuum packaging according to claim 3, wherein, if $0<\Delta t<25$ s, $p_1=0.8$.

6. The smart heat sealing method for vacuum packaging according to claim 3, wherein, if $\Delta t>600$ s, $p_1=1.2$.

7. The smart heat sealing method for vacuum packaging according to claim 1, wherein the second heating coefficient $p_2$ and the number k of starts have relationships as follows:

$$\text{if } k = 1,\ p_2 > 1;$$

$$\text{if } 1 < k \le K,\ p_2 = 1;\ \text{and}$$

$$\text{if } k > K,\ 0 < p_2 < 1;$$

wherein K indicates a critical value of the number of times of continuous starts of the heating device.

* * * * *